US005931664A

United States Patent [19]

Musschoot et al.

[11] Patent Number: 5,931,664

[45] Date of Patent: Aug. 3, 1999

[54] NON-MECHANICAL LEAK-PROOF COUPLING

[75] Inventors: Albert Musschoot, Barrington Hills; Daniel T. Lease, McHenry, both of Ill.

[73] Assignee: General Kinematics Corporation, Barrington, Ill.

[21] Appl. No.: 08/843,814

[22] Filed: Apr. 21, 1997

[51] Int. Cl.[6] ..... F27B 5/16

[52] U.S. Cl. ..... 432/201; 432/58; 432/196; 432/205; 110/245; 137/888; 137/891

[58] Field of Search ..... 138/44; 137/888, 137/891; 164/404; 432/58, 177, 193, 196, 200, 201, 205; 110/245, 147, 150, 157, 160, 161, 163; 122/4 D, 38, 209.2, 420, 421, 422, 428, 432, DIG. 3, DIG. 7, DIG. 15

[56] References Cited

U.S. PATENT DOCUMENTS

| | | | |
|---|---|---|---|
| 144,586 | 11/1873 | Wingate . | |
| 904,614 | 11/1908 | Hatz | 110/150 |
| 1,195,915 | 8/1916 | Damrow . | |
| 2,379,916 | 7/1945 | McIntosh | 110/150 |
| 2,488,090 | 11/1949 | McIntosh . | |
| 2,670,011 | 2/1954 | Bertin et al. | 138/44 |
| 2,722,372 | 11/1955 | Edwards . | |
| 2,979,322 | 4/1961 | Dailey, Jr. . | |
| 3,768,962 | 10/1973 | Baranowski, Jr. | 431/353 |
| 4,118,173 | 10/1978 | Shakiba | 431/202 |
| 4,192,658 | 3/1980 | Worrell | 48/192 |
| 4,380,189 | 4/1983 | Vicard . | |
| 4,452,277 | 6/1984 | Wells | 138/44 |
| 5,002,092 | 3/1991 | Oirschot | 137/891 |
| 5,429,156 | 7/1995 | Ueda et al. | 137/888 |

FOREIGN PATENT DOCUMENTS

| | | | |
|---|---|---|---|
| 2362519 | 6/1975 | Germany | 138/44 |
| 445630 | 4/1936 | United Kingdom | 137/891 |

*Primary Examiner*—Carl D. Price
*Assistant Examiner*—Ljiljana V. Ciric
*Attorney, Agent, or Firm*—Marshall, O'Toole, Gerstein, Murray & Borun

[57] ABSTRACT

A non-mechanical leak proof coupling for use on a gas carrying pipe having two pipe sections which are moveable relative to each other. The coupling includes a first pipe section having an upstream end in flow communication with a stationary gas source and further includes a second pipe section having a downstream end in flow communication with a vibrating distribution chamber. A downstream end of the first pipe section and an upstream end of the second pipe section are disposed in closely spaced relation to define a gap therebetween. The first pipe section downstream end is in flow communication with the second pipe section upstream end such that the pressurized gas is communicated between the first pipe section to the second pipe section for discharge to the vibrating distribution chamber. The coupling includes structure to cause the gas to be accelerated from a first velocity to a faster second velocity as the gas travels across the gap between the first pipe section and the second pipe section, which thereby creates a negative pressure differential relative to ambient air pressure to prevent the gas from escaping through the gap.

16 Claims, 4 Drawing Sheets

NON-MECHANICAL LEAK-PROOF COUPLING

FIELD OF THE INVENTION

The present invention is generally directed to leak-proof couplings for conduits, pipes and the like and, more particularly, a non-mechanical leak-proof coupling for a gas-carrying pipe connected to a vibrating chamber.

BACKGROUND OF THE INVENTION

Over the years, there have been developed a wide variety of different couplings for conduits, pipes and the like. These have typically taken the form of a mechanical coupling that is either rigid or semi-rigid in form, especially where there is a requirement that the coupling be leak-proof in applications where the conduit or pipe carry a liquid or gas. With such mechanical couplings, it has been commonplace to utilize a seal that is in contact with each of the adjoining ends of the conduit or pipe.

While the design of such couplings and seals has evolved to a significant extent, there exists certain applications where rigid or semi-rigid mechanical couplings are not suitable. This is the case, for instance, whenever two conduit or pipe sections must be joined in a leak-proof manner while at the same time permitting some degree of relative movement therebetween. For this purpose, a flexible coupling may be required to provide a leak-proof connection since a rigid or semi-rigid mechanical coupling would not be suitable in all likelihood.

Unfortunately, a flexible coupling also may not be suitable for every application where a leak-proof connection is necessary between two relatively movable conduit or pipe sections. Most typical flexible couplings have taken the form of a sleeve of a flexible material such as rubber or the like, and there are many applications in which the conduit or pipe sections must carry a high temperature fluid or a fluid having corrosive or other deleterious characteristics. In these cases, it is difficult, if not impossible, to select a material for the flexible coupling that is capable of withstanding the extreme environmental characteristics of the fluid.

Since the fluid would necessarily be in contact with the flexible coupling through a gap between the ends of the two conduit or pipe sections, this problem is critical for those applications in which the ends of the conduit or pipe sections must accommodate some degree of relative movement.

In one particular application, a pressurized gas is transferred from a stationary source to a vibrating chamber through a gas-carrying conduit. This application is one in which the vibrating chamber may comprises an integral portion of a vibratory fluidized bed that is utilized to reclaim foundry sand by burning off the binder. The gas-carrying conduit typically will include a first conduit section having both an upstream end connected to the stationary source for the pressurized gas and a spaced coupling end. The gas-carrying conduit will also include a second conduit section having both a second coupling end near the first coupling end of the first conduit section and a spaced downstream end connected to the vibrating chamber. This application typically utilizes pressurized air that is heated to a temperature of at least 600° F. and delivered to the vibrating chamber for fluidizing sand in the vibratory fluidized bed. Due to the relative movement of the conduit sections caused by the vibrating motion, there must exist a gap between the first and second coupling ends thereof.

For this application, a flexible mechanical coupling will be understood to present a problem in view of the high temperature of the pressurized air. There must necessarily be way to accommodate the relative movement between the first and second coupling ends of the conduit sections, thereby requiring the gap therebetween, but this means that either the material of the flexible mechanical coupling must be such as to withstand the high temperature of the pressurized air, or the flexible mechanical coupling must be isolated from exposure to the hot pressurized air. In either case, any solution in the form of a flexible mechanical coupling is quite necessarily understood to be complex and expensive.

The present invention is directed to overcoming one or more of the foregoing problems while achieving one or more of the resulting objects by providing a unique non-mechanical leak-proof coupling.

SUMMARY OF THE INVENTION

It is an object of the present invention to provide a non-mechanical leak-proof coupling for a gas-carrying pipe. It is a further object of the invention to provide a leak-proof coupling for a gas-carrying conduit in an apparatus suitable for transferring a pressurized gas from a stationary source to a vibrating chamber through the gas-carrying conduit. It is a further object of the present invention to provide such a non-mechanical leak-proof coupling for transferring hot pressurized air.

Accordingly, the present invention is directed to a leak-proof coupling for a gas-carrying pipe including a first pipe section having an upstream end which receives a pressurized gas and also including a second pipe section having a downstream end for discharge of the pressurized gas. The pressurized gas is received through the upstream end of the first pipe section from a source and flows through the first pipe section from the upstream end to a first coupling end for discharge therefrom. The pressurized gas is then received through a second coupling end of the second pipe section and flows through the second pipe section from the second coupling end to the downstream end for discharge therefrom. Still additionally, the first and second coupling ends of the first and second pipe sections are disposed in closely spaced adjacent relation to define a gap therebetween such that the first and second pipe sections are in communication through the gap with external ambient conditions.

With this arrangement, the present invention achieves the non-mechanical leak-proof coupling by utilizing means for accelerating the pressurized gas from a first velocity upstream of the first coupling end to a second, greater velocity as the pressurized gas flows by the gap between the first and second coupling ends to produce a negative pressure differential relative to external ambient conditions to prevent the pressurized gas from escaping through the gap.

In one form of the invention, the pressurized gas accelerating means comprises a conical venturi which is disposed within the first pipe section and has a restricted orifice that is positioned at the first coupling end so as to be substantially adjacent the gap. In another form of the invention, the pressurized gas accelerating means comprises an orifice plate which is disposed within the first pipe section and is positioned at the first coupling end so as to be substantially adjacent the gap. In yet another form of the invention, the pressurized gas accelerating means comprises forming the first pipe section adjacent the first coupling end to have a first inner diameter and forming the second pipe section adjacent the second coupling end to have a second, greater inner diameter.

In a highly preferred embodiment, an apparatus for transferring hot pressurized air from a stationary heater or furnace to a chamber of a vibratory fluidized bed through a hot air-carrying pipe includes a non-mechanical leak-proof coupling. The coupling comprises a first pipe section having an upstream end connected to the heater or furnace supplying the hot pressurized air and a first coupling end remote therefrom such that the upstream end receives the hot pressurized air from the heater or furnace and the hot pressurized air then flows through the first pipe section from the upstream end to the first coupling end for discharge therefrom. The coupling also comprises a second pipe section having a second coupling end in communication with the first coupling end and a downstream end remote therefrom such that the second coupling end receives the hot pressurized air from the first pipe section and the hot pressurized air then flows through the second pipe section from the second coupling end to the downstream end for discharge therefrom. Still additionally, this particular highly preferred embodiment includes a hot air chamber which is integrally connected to the downstream end of the second pipe section in order to receive the hot pressurized air therewithin.

More specifically, the first and second pipe sections define a flow path for the hot pressurized air from the heater or furnace to the hot air chamber which is in communication with and connected integrally to the fluidized bed which vibrates in such manner as to cause the hot air chamber and the second pipe section to vibrate therewith. The first and second coupling ends of the first and second pipe sections are disposed in closely spaced adjacent relation to define a gap therebetween such that the first and second pipe sections are in communication through the gap with external ambient conditions and, additionally, means are provided for accelerating the hot pressurized air from a first velocity upstream of the first coupling end to a second, greater velocity as the hot pressurized air flows past the gap between the first and second coupling ends. In this manner, a negative pressure differential is produced relative to external ambient conditions that prevents the hot pressurized air from escaping through the gap which is selected to draw a desired volume of air through the gap which is mixed with the hot pressurized air prior to delivery to the hot air chamber.

In a most highly preferred embodiment, the first and second pipe sections comprise pipes of substantially equal inner diameter, the first and second coupling ends comprise first and second flanges, and the first and second flanges have confronting surfaces defining the gap between the first and second pipes. It is also highly advantageous for the confronting surfaces of the first and second flanges to normally be disposed in generally parallel planes extending generally perpendicular to longitudinal axes of the first and second pipes in spaced relation by the selected amount to define the gap therebetween. Still further, first and second flanges are preferably formed of one or more materials which exhibit bearing characteristics in order to accommodate the possibility that the confronting surfaces of the first and second flanges may make contact when the vibrating means causes the second pipe to vibrate with the hot air chamber relative to the first pipe.

In the most highly preferred embodiment, the pressurized gas accelerating means comprises a conical venturi disposed within the first pipe and having a restricted orifice therein which is positioned substantially adjacent the first flange so as to be substantially adjacent the gap. The conical venturi preferably has a first diameter at an upstream end thereof substantially equal to the inner diameters of the first and second pipes and a second, lesser diameter at a downstream end thereof defining the restricted orifice substantially adjacent the gap. The pressurized air accelerating means may also preferably include a second conical venturi which is disposed within the second pipe and having a restricted orifice therein which is positioned substantially adjacent the second flange so as to be substantially adjacent the gap. Further, the second conical venturi preferably has a first diameter at an upstream end thereof defining the restricted orifice substantially adjacent the gap and a second, greater diameter at a downstream end thereof substantially equal to the inner diameters of the first and second pipes.

Other objects, advantages and features of the present invention will become apparent from a consideration of the following specification taken in conjunction with the accompanying drawings.

DETAILED DESCRIPTION OF THE PREFERRED EMBODIMENTS

Figure 1:
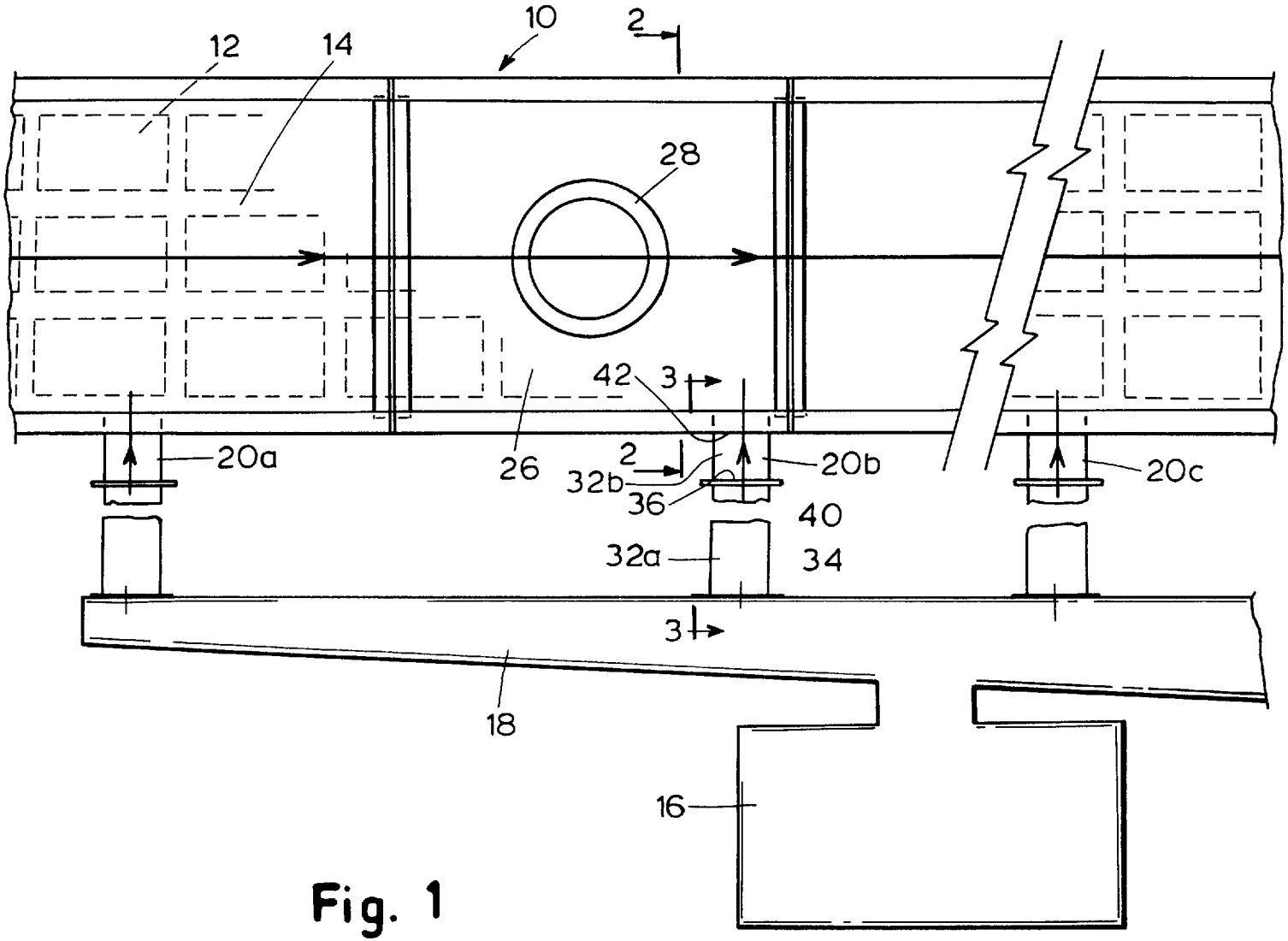
FIG. 1 is a plan view of a vibratory fluidized bed utilizing a non-mechanical leak-proof coupling in accordance with the present invention.
Figure 2:
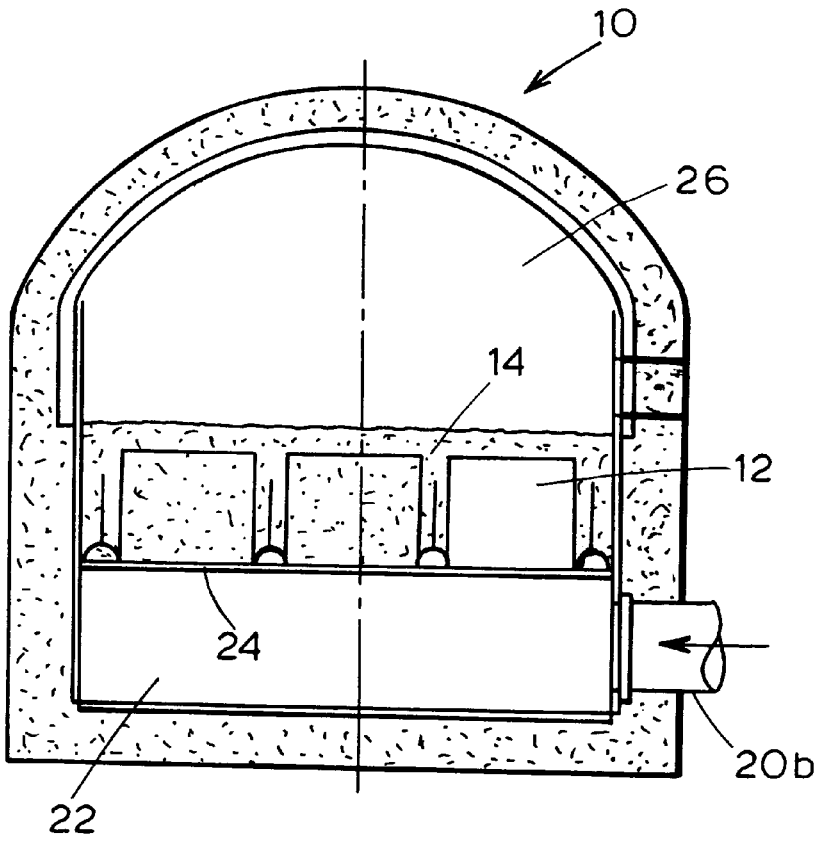
FIG. 2 is a cross-sectional view of the fluidized bed taken generally along the lines 2—2 of FIG. 1.

In the illustrations given, and with reference first to FIGS. 1 and 2, the reference numeral 10 designates generally an apparatus and system for removing and reclaiming sand from a metal casting in accordance with commonly owned, co-pending patent application of Albert Musschoot for Vibratory Sand Reclamation System, U.S. Ser. No. 08/770,343, filed Dec. 20, 1996. The teachings of the aforementioned co-pending patent application are incorporated herein by reference wherein the apparatus 10 is utilized to process metal castings such as 12, each having its sand mold and sand cores still in place as it follows a continuous, vibrated path extending from a casting loading conveyor (not shown) to a casting entrance (not shown) of a fluidized bed 14 where processing takes place. As pertinent to the present invention, hot, pressurized air is produced in a hot air supply heater or furnace 16. The hot, pressurized air is fed to a distribution manifold 18 where it passes through a plurality of hot pressurized air-carrying conduits or pipes 20*a*, 20*b*, 20*c*, etc. into a vibrating distribution chamber 22 for passage through a permeable surface 24 such as a perforated plate or other suitable means preferably having one or more openings to provide for passage and distribution of the fluidizing hot, pressurized air. As will be appreciated, the permeable surface thereby accommodates the requirement for the hot, pressurized air to pass from beneath the vibratory fluidized bed 14 into the sand within the vibratory fluidized bed 14 to cause the sand to become fluidized in accordance with the teachings of U.S. Ser. No. 08/770,343, filed Dec. 20, 1996, which has been incorporated herein by reference.

As will be recognized by those skilled in the art, the hot, pressurized air fed to the vibrating distribution chamber 22 is forced through suitable openings located substantially entirely along the floor 24 into the sand bed surrounding the sand molds containing the metal castings 12. The hot, pressurized air thereby fluidizes and further heats the sand in the vibratory fluidized bed 14 to pyrolize the resin bonding material in the sand molds and sand cores. As the sand molds containing the metal castings 12 move through the heated chamber 26 comprising the vibratory fluidized bed 14, the binder in the sand molds and sand cores pyrolizes, the pyrolized binder is vented from the vibratory fluidized bed 14 through vent stacks 28 at the top of the heated chamber 26, and the reclaimed sand from the sand molds and sand cores mixes with the fluidized sand about the metal castings 12.

As for other details of the apparatus and system 10, they may be derived by reference to the teachings of the aforementioned co-pending patent application which have been incorporated herein by reference.

Figure 3:
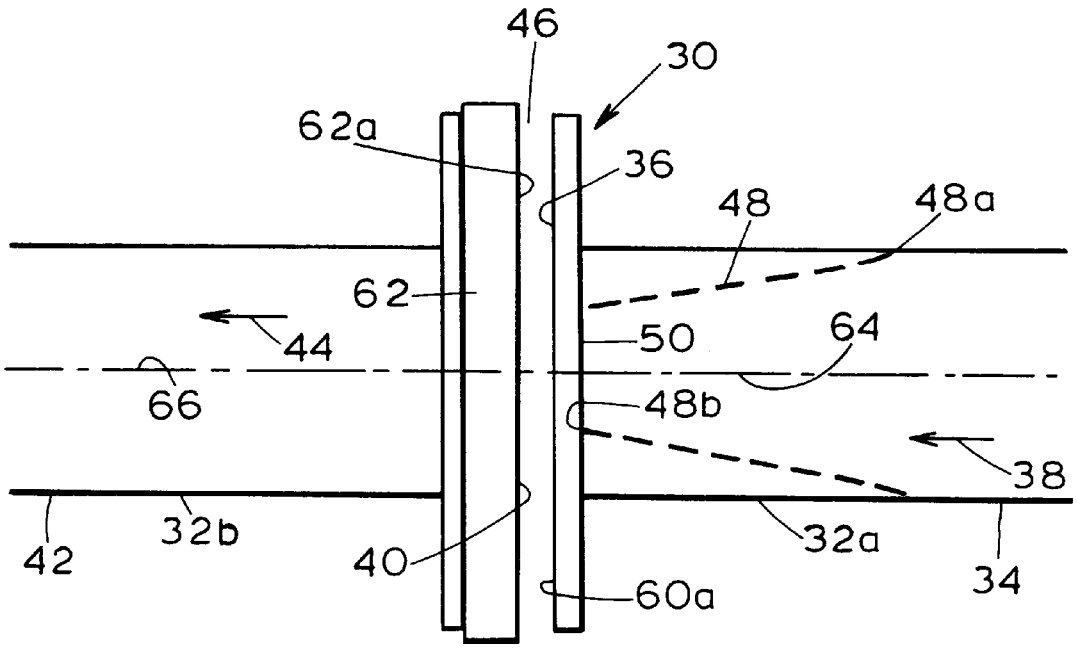
FIG. 3 is a fragmentary cross-sectional view taken along line 3—3 of FIG. 1 view illustrating the non-mechanical leak-proof coupling of the present invention.

Referring now to FIGS. 1–3, the details of the present invention, which have been shown in relation to the apparatus and system 10, can be fully understood. It will be appreciated in this connection that the present invention has been shown in conjunction with the apparatus and system 10 merely for illustrative purposes as to one potential significant application. Of course, the present invention can also be of significant benefit in a wide variety of other applications that will be clearly suggested to those of ordinary skill in the art.

As specifically illustrated in FIG. 3, the present invention is directed to a non-mechanical leak-proof coupling generally designated 30 for a gas-carrying pipe having a first pipe section 32*a* and a second pipe section 32*b*. The first pipe section 32*a* has an upstream end 34 in communication with a source of a pressurized gas, such as the heater or furnace 16, and a first coupling end 36 remote therefrom. The upstream end 34 receives the pressurized gas from the heater or furnace 16 after it has been discharged into the distribution manifold 18 in the case of the apparatus and system 10 shown in FIG. 1. As will be appreciated by the arrow 38 in FIG. 3, the pressurized gas flows through the first pipe section 32*a* from the upstream end 34 to the first coupling end 36 for discharge therefrom.

As will also be appreciated from FIG. 3, the second pipe section 32*b* has a second coupling end 40 in communication with the first coupling end 36 of the first pipe section 32*a* and a downstream end 42 remote therefrom (see, also, FIG. 1). The second coupling end 40 receives the pressurized gas from the first pipe section 32*a* after it is discharged from the first coupling end 36 thereof. As will also be appreciated from FIG. 3, the pressurized gas then flows through the second pipe section 32*b* as indicated by the arrow 44 from the second coupling end 40 to the downstream end 42 for discharge into the vibrating distribution chamber 22 (see, also, FIG. 2).

As shown most clearly in FIG. 3, the first and second coupling ends 36 and 40 of the first and second pipe sections 32*a* and 32*b*, respectively, are disposed in closely spaced adjacent relation to define a gap generally designated 46 therebetween. This gap 46 is such that the first and second pipe sections 32*a* and 32*b* are not in close enough proximity that they could normally prevent escape of the pressurized gas flowing through the first and second pipe sections 32*a* and 32*b* as represented by the arrows 38 and 44, respectively, but are such that the first and second pipe sections 32*a* and 32*b* are in open communication through the gap 46 with external ambient conditions. Thus, in accordance with the present invention, the non-mechanical leak-proof coupling 30 includes means for accelerating the pressurized gas such as a conical venturi 48 to keep the pressurized gas from escaping through the gap 46.

More specifically, the conical venturi 48 causes the pressurized gas to accelerate from a first velocity upstream of the first coupling end 36 to a second, greater velocity as the pressurized gas flows past the gap 46 between the first and second coupling ends 36 and 40. This produces a negative pressure differential in the region of the gap 46 relative to external ambient pressure conditions (normally atmospheric pressure) to prevent the pressurized gas from escaping through the gap 46. In addition, the negative pressure differential is such as to cause external air to be drawn through the gap 46 where it mixes with the pressurized gas as it flows through the second pipe section 32*b* for discharge at the downstream end 42 into the vibrating distribution chamber 22.

As fully illustrated in FIG. 3, the conical venturi is preferably disposed within the first pipe section 32*a* so as to have an upstream end 48*a* positioned between the upstream end 34 and the first coupling end 36 of the first pipe section 32*a*. It will also be appreciated that the conical venturi 48 is formed so as to have its downstream 48*b* positioned at a point substantially adjacent the gap 46. Further, the conical venturi 48 preferably has a first inner diameter substantially identical to the inner diameter of the first pipe section 32*a* at the upstream end 48*a* and a second, lesser inner diameter at the downstream end 48*b* defining a restricted orifice 50.

Figure 5:
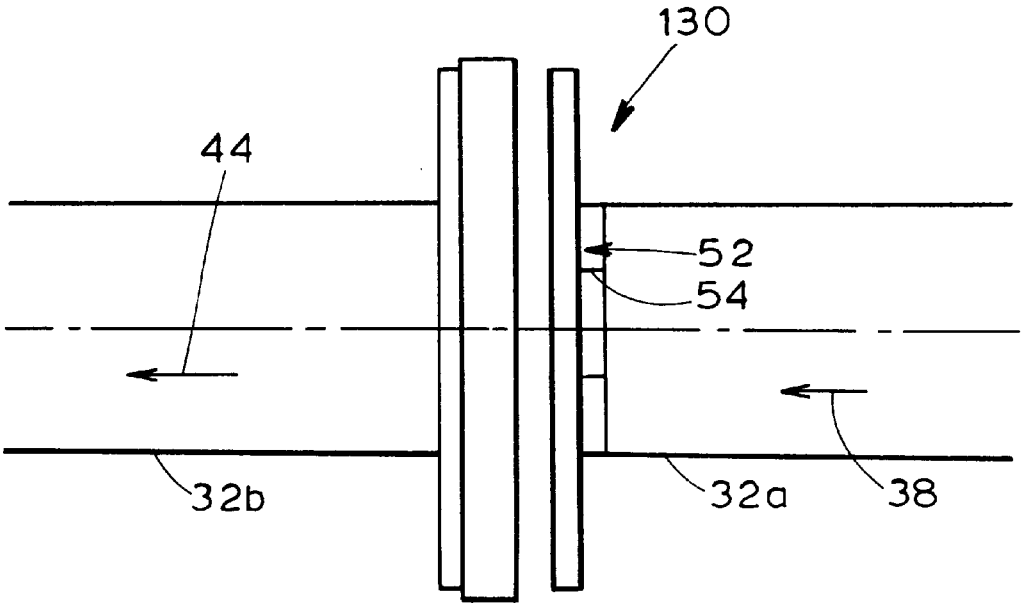
FIG. 5 is a view of a fragmentary cross-sectional view similar to FIGS. 3 and 4 but illustrating second alternative embodiment of the coupling of the present invention.

Referring now to FIG. 5, an alternative embodiment of a non-mechanical leak-proof coupling has been illustrated that incorporates the features of, and is fully in accordance with, the present invention. It will be seen in FIG. 5 that a leak-proof coupling 130 has been shown which comprises an orifice plate generally designated 52 which may take the form of any conventional orifice plate including the one illustrated which is generally donut shaped so as to have a central restricted orifice 54 through which the pressurized gas flowing through the first pipe section 32*a* passes. In this embodiment, the orifice plate 52 is preferably is positioned at the first coupling end 36 substantially adjacent the gap 46 in place of the conical venturi 48.

Figure 6:
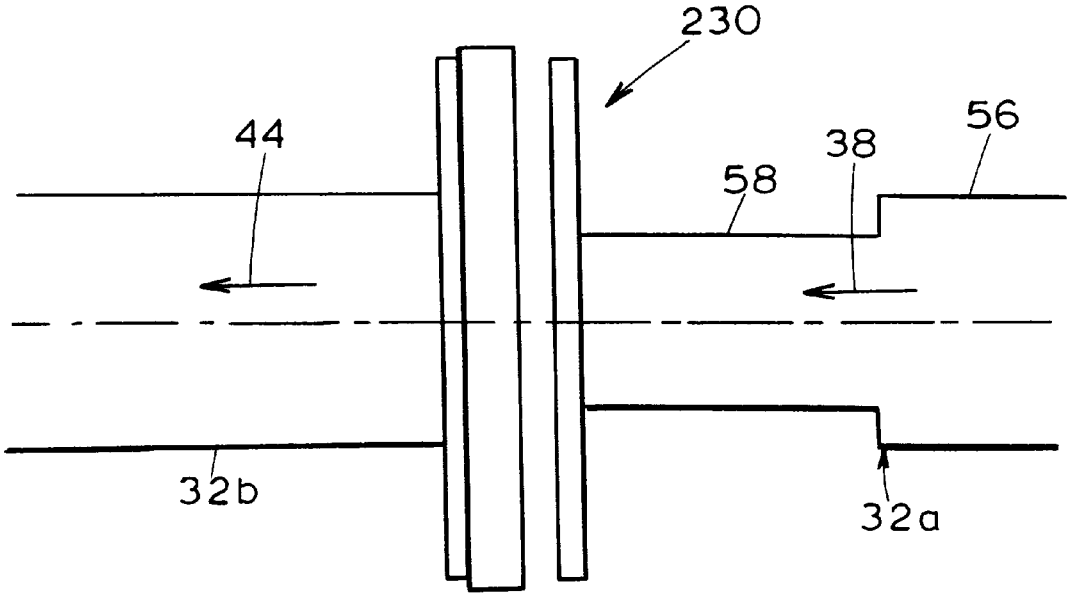
FIG. 6 is a fragmentary cross-sectional view similar to FIGS. 3 through 5 but illustrating a third alternative embodiment of the coupling of the present invention.

Referring now to FIG. 6, another alternative embodiment of a non-mechanical leak-proof coupling has been illustrated that incorporates the features of, and is fully in accordance with, the present invention. It will be seen in FIG. 6 that a leak-proof coupling 230 has been shown which comprises a first pipe section 32*a* that is configured to have a stepped inner diameter and, more specifically, to have a major portion generally designated 56 of a first inner diameter and a minor portion generally designated 58 having a second, smaller inner diameter along the portion of its length extending to and in communication with the gap 46 through the first coupling end 36. In this embodiment, the reduced inner diameter portion 58 is suitably positioned at the first coupling end 36 to discharge the pressurized gas substantially adjacent the gap 46 in place of the conical venturi 48.

As with the conical venturi 48, the orifice plate 52 and the reduced inner diameter portion 58 each cause the pressurized gas to accelerate as it flows by the gap 46 between the first and second coupling ends 36 and 40.

In the illustrated application for the couplings 30, 130 and 230, the present invention comprises a portion of an apparatus for transferring hot pressurized air from a stationary heater or furnace such as 16 to a vibrating distribution chamber such as 22 of a vibratory fluidized bed such as 14 through a hot pressurized air-carrying pipe or conduit 20*a*, 20*b*, 20*c*, etc. (see FIGS. 1–3). The hot pressurized air-carrying conduit or pipes each include a first conduit or pipe section 32*a* having an upstream end 34 connected to the heater or furnace 16 either directly or, as shown in FIG. 1, indirectly through a distribution manifold 18. The hot pressurized air that is received by the upstream end 34 of the first conduit or pipe section 32*a* flows through the section 32*a* for discharge at the first coupling end 36. The hot air-carrying pipes also each include a second conduit or pipe section 32*b* having a second coupling end 40 in communication with the first coupling end 36 to receive the hot pressurized air from the first pipe section 32*a*. As best understood from FIGS. 2 and 3, the hot pressurized air then flows through the section 32*b* for discharge at the downstream end 42 of the second pipe section 32*b* which is connected to the vibrating hot air chamber 22 that receives the hot pressurized air for delivery through perforations (not shown) in the floor 24 of the vibratory fluidized bed 14.

As will now be fully appreciated, the first and second pipe sections 32*a* and 32*b* define a flow path for the hot pressurized air from the heater or furnace 16 to the vibrating hot air chamber 22 which is in communication with and connected integrally to the vibratory fluidized bed 14 to provide hot pressurized air for fluidizing sand therewithin.

Referring once again to FIG. 3, the first and second pipe sections 32*a* and 32*b* may advantageously comprise pipes of substantially equal inner diameter, the first and second coupling ends 36 and 40 preferably are defined by first and second flanges 60 and 62, respectively, and the first and second flanges 60 and 62 have confronting surfaces 60*a* and 62*a* defining the gap 46 between the first and second pipes 32*a* and 32*b*. It will also be appreciated that the confronting surfaces 60*a* and 62*a* of the first and second flanges 60 and 62 are normally disposed in generally parallel planes extending generally perpendicular to longitudinal axes 64 and 66 of the first and second pipes 32*a* and 32*b* in spaced relation by the selected amount to define the gap 46 therebetween. With this arrangement, the first and second flanges 60 and 62 are advantageously formed of one or more materials exhibiting bearing characteristics (such as cast iron and steel in the application illustrated) to accommodate the possibility that the confronting surfaces 60*a* and 62*a* may make contact when the vibrating means (see co-pending patent application U.S. Ser. No. 08/770,343, filed Dec. 20, 1996) causes the second pipe 32*b* to vibrate with the vibrating hot air chamber or plenum 22.

As for the vibrational movement imparted to the second pipe 32*b*, it will normally be such as to cause the confronting surface 62*a* to move within the plane of the confronting surface 62*a* so as to be generally perpendicular to the longitudinal axes 64 and 66.

Figure 4:
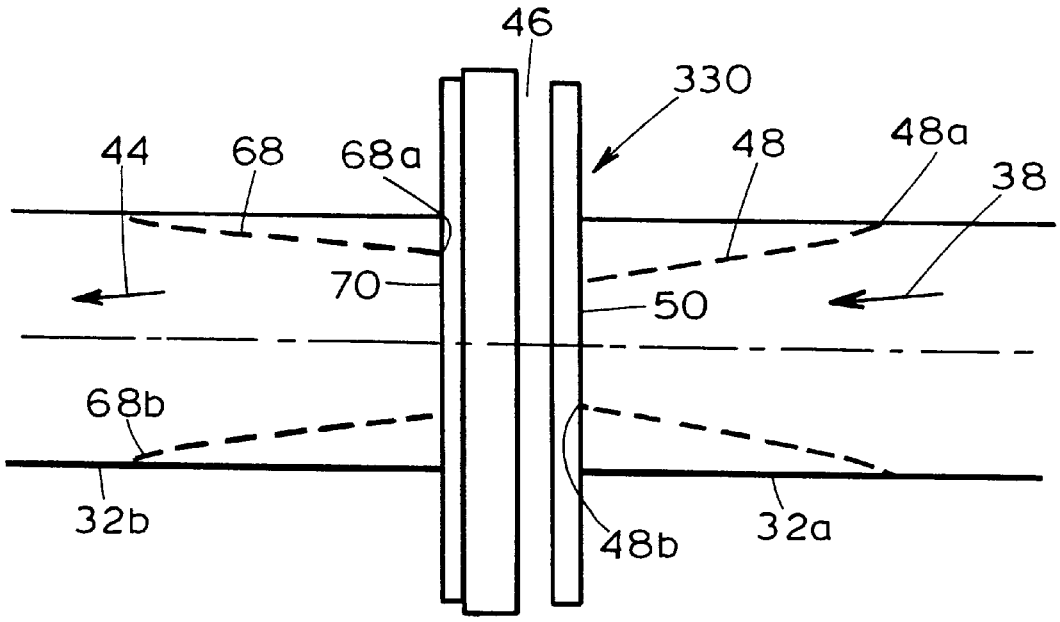
FIG. 4 is a fragmentary cross-sectional view similar to FIG. 3 but illustrating a first alternative embodiment of the coupling of the present invention.

Referring to FIG. 4, another alternative embodiment of the non-mechanical leak-proof coupling has been illustrated. It will be appreciated that this coupling 330 is similar to that illustrated and described in connection with FIG. 3 with the exception that the pressurized air accelerating means includes not only the conical venturi 48, but also a second conical venturi 68 disposed within the second pipe 32b and having a restricted orifice 70 therein. As shown, the restricted orifice 70 is positioned substantially adjacent the second flange 62 so as to be substantially adjacent the gap 46.

Still referring to FIG. 4, the second conical venturi 68 has a first inner diameter at an upstream end 68*a* thereof defining the restricted orifice 70 and a second, greater inner diameter at a downstream end 68*b* substantially equal to the inner diameter of the second pipe 32*b*. It will be appreciated, moreover, that the first and second conical venturis 48 and 68 may advantageously comprise mirror images of one another such that the restricted orifices 50 and 70 are substantially coaxial. Preferably, the restricted orifice 70 of the second, or downstream conical venturi 68 will be larger than the restricted orifice 50 of the first, or upstream conical venturi 48. This will serve to accommodate for vibrational movement of the second pipe 32*b* relative to the first pipe 32*a* in a direction generally perpendicular to the longitudinal axis 66. Advantageously, the restricted orifice 70 will be sized in relation to the restricted orifice 50 to fully capture the flow of air or gas passing through the first pipe 32*a* as the second pipe 32*b* undergoes vibrational movement. It will be appreciated, however, that the inner diameters at the respective upstream and downstream ends 48*a* and 68*b* of the first and second conical venturis 48 and 68 may suitably have inner diameters that are substantially equal to each other as well as the inner diameters of the first and second pipes 32*a* and 32*b*. While the non-mechanical leak-proof coupling 330 may advantageously be utilized in certain applications, other applications may be successfully addressed utilizing only a single conical venturi such as 48 which is illustrated and described in connection with FIG. 3.

Figure 7:
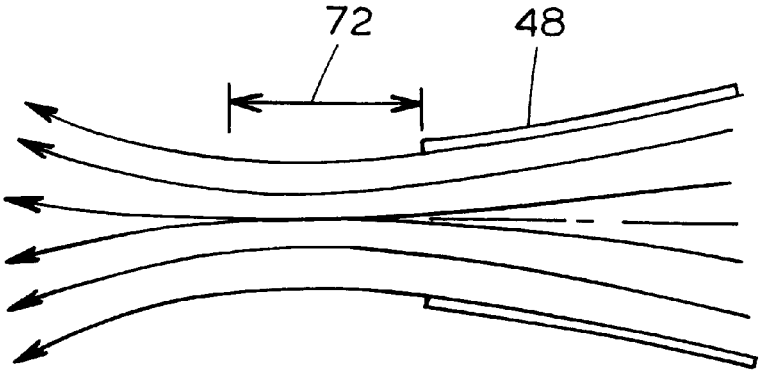
FIG. 7 is a schematic view illustrating the fluid flow pattern of the non-mechanical leak-proof coupling of FIG. 3.

Referring to FIG. 7, the flow pattern for the air or gas being transported by the first and second conduit or pipe section 32*a* and 32*b* through the conical venturi 48 of the non-mechanical leak-proof coupling 30 may be fully understood. It will be appreciated that the conical venturi 48 will cause the air or gas to accelerate as it moves from the upstream end 48*a* to the downstream end 48*b* thereof from a first velocity to a second, higher velocity, following which it gradually expands to fill the full inner diameter of the second conduit or pipe section 32*b* downstream of the gap 46, second coupling end 40, and second flange 62. In the region of flow 72 immediately downstream of the restricted orifice 50, the air or gas will have a maximum velocity and minimum static pressure that will cause external air to be drawn through the gap 46 as previously described.

For applications such as the apparatus and system 10, this additional air is needed in order to provide sufficient oxygen to cause the binder in the sand of the sand molds and sand cores to be combusted within the vibratory fluidized bed 14. The amount of air can be controlled in various ways including variation of the size of the gap 46 and selection of the degree of taper and the size of the restricted orifice 50 of the conical venturi 48. Still additionally, this can be controlled by controlling the pressure of the air or gas that is provided by the source such as the heater or furnace 16 or in still other ways that will be readily apparent to those who are skilled in the art.

While in the foregoing there have been set forth preferred embodiments of the invention, it will be appreciated that the details herein given may be varied by those skilled in the art without departing from the true spirit and scope of the appended claims.

What is claimed is:

1. In an apparatus for transferring a pressurized gas from a stationary source to a vibrating distribution chamber through a gas-carrying conduit, a leak-proof coupling for said gas-carrying conduit, comprising:

a first conduit section having an upstream end connected to the stationary pressurized gas source and having a first coupling end spaced downstream from the upstream end, said upstream end receiving the pressurized gas from the pressurized gas source, the pressurized gas flowing through said first conduit section from said upstream end toward said first coupling end;

a second conduit section having a second coupling end in communication with said first coupling end and a downstream end remote therefrom, said second coupling end receiving said pressurized gas from said first conduit section, said pressurized gas flowing through said second conduit section from said second coupling end toward the vibrating distribution chamber;

the vibrating distribution chamber being in flow communication with said downstream end of said second conduit section, said vibrating distribution chamber being adapted to receive said pressurized gas, said first and second conduit sections defining a flow path for said pressurized gas from said stationary source to said vibrating distribution chamber, the second conduit section being adapted to vibrate along with the vibrating distribution chamber;

said first and second coupling ends of said first and second conduit sections being disposed in closely spaced adjacent relation to define a gap between the first and second coupling ends such that said first and second conduit sections are in communication through said gap with external ambient conditions; and means for accelerating said pressurized gas from a first velocity upstream of said first coupling end to a second, greater velocity as said pressurized gas flows by said gap between said first and second coupling ends, thereby producing a negative pressure differential relative to external ambient conditions to prevent said pressurized gas from escaping through said gap.

2. The apparatus of claim 1 wherein said first and second conduit sections comprise first and second pipes, and wherein each of said first and second coupling ends includes a flange, each of said first and second flanges having a confronting surface, said flanges defining said gap between said first and second pipes.

3. The apparatus of claim 2, wherein each of said first and second conduit sections includes a longitudinal axis, and wherein said confronting surfaces of said first and second flanges are disposed in generally parallel planes extending generally perpendicular to said longitudinal axes of said first and second pipes, said flanges being disposed in spaced relation by a preselected amount to define said gap therebetween.

4. The apparatus of claim 2 wherein said confronting surface of said first and second flanges are adapted to permit repetitive vibratory contact between said first and second flanges as said second vibrates with said chamber.

5. The apparatus of claim 1 wherein said pressurized gas accelerating means comprises an orifice plate disposed within said first conduit section substantially adjacent to said first coupling end and further being positioned substantially adjacent to said first flange so as to be in close proximity to said gap.

6. The apparatus of claim 5 wherein said accelerating means includes a conical venturi, the conical venturi including a first diameter at an upstream end thereof and a second, lesser diameter at a downstream end defining a restricted orifice, and further wherein said second conduit section include an inner diameter greater than said second, lesser diameter of said conical venturi.

7. The apparatus of claim 1 wherein said pressurized gas accelerating means comprises a conical venturi disposed within said first conduit section, said conical venturi having a restricted orifice, said conical venturi being disposed within the first conduit section such that the restricted orifice is positioned substantially adjacent said gap.

8. A leak proof coupling for transferring a pressurized gas between a stationary gas source adapted to supply pressurized gas at a first velocity and a vibrating distribution chamber adapted to receive the pressurized gas, the leak proof coupling comprising:

a first conduit section having an upstream end and a downstream end, the first conduit section upstream end being in flow communication with the stationary gas source, the first conduit section downstream end including a planar flange;

a second conduit section having an upstream end and a downstream end, the second conduit section upstream end including a planar flange, the second conduit section downstream end being in flow communication with the vibrating distribution chamber, the second conduit section being rigidly attached to the vibrating distribution chamber and being adapted to vibrate therewith;

the first conduit section flange and the second conduit section flange being disposed in spaced apart parallel relationship to define a gap therebetween, the gap having a major plane disposed generally parallel to the first and second conduit section flanges; and an orifice disposed within the first conduit section downstream end generally adjacent to the first conduit section flange, the orifice being adapted to accelerate the gas flowing through the orifice from the first velocity to a second, greater velocity;

whereby a negative pressure differential is created in the region of the gap such that gas flowing through the leak proof coupling does not escape to the surrounding atmosphere.

9. The leak proof coupling of claim 8, wherein the first conduit section is connected to the pressurized gas source by a rigid pipe.

10. The leak proof coupling of claim 8, wherein the second conduit section is connected to the vibrating distribution chamber by a rigid pipe.

11. The leak proof coupling of claim 8, wherein the first conduit section is connected to the pressurized gas source by a rigid pipe section, and wherein the second conduit section is connected to the vibrating distribution chamber by a rigid pipe section.

12. The leak proof coupling of claim 8, wherein each of the first and second conduit sections includes a longitudinal axis, and wherein the first and second conduit section flanges are disposed generally perpendicular their respective longitudinal axis.

13. The leak proof coupling of claim 8, wherein each of the first and second conduit section flanges includes a generally planar bearing surface, the first and second flange bearing surfaces being adapted to permit contact between the flanges.

14. The leak proof coupling of claim 8, wherein the orifice includes a conical venturi, the conical venturi including an upstream end having a first diameter and further including a downstream end having a second diameter, the second diameter being less than the first diameter.

15. The leak proof coupling of claim 8, wherein the first conduit section includes a diameter and wherein the orifice includes a circular plate disposed with the first conduit section generally adjacent the first conduit section flange, the circular plate having a central orifice, the central orifice having a diameter less than the diameter of the first conduit section.

16. A leak proof coupling for transferring a pressurized gas between a stationary gas source adapted to supply pressurized gas at a first velocity and a vibrating distribution chamber adapted to receive the pressurized gas, the leak proof coupling comprising:

a first conduit section having an upstream end and a downstream end, the first conduit section upstream end being rigidly connected to and in flow communication with the stationary gas source, the first conduit section downstream end including a planar flange;

a second conduit section having an upstream end and a downstream end, the second conduit section upstream end including a planar flange, the second conduit section downstream end being rigidly connected to and in flow communication with the vibrating distribution chamber, the second conduit section being adapted to vibrate along with the vibrating distribution chamber;

the first conduit section flange and the second conduit section flange being disposed in spaced apart parallel relationship to define a peripheral gap, the gap being disposed in a major plane lying generally parallel to the first and second conduit section flanges, each of the first and second conduit section flanges including a generally planar bearing surface, the first and second flange bearing surfaces being adapted to permit repetitive vibratory contact between the flanges; and an orifice disposed within the first conduit section downstream end generally adjacent to the first conduit section flange, the orifice being adapted to accelerate the gas flowing through the orifice from the first velocity to a second, greater velocity so that a negative pressure differential is created in the region of the gap such that gas flowing through the leak proof coupling does not escape to the surrounding atmosphere.

* * * * *